US007899390B1

(12) United States Patent
Littlejohn et al.

(10) Patent No.: US 7,899,390 B1
(45) Date of Patent: Mar. 1, 2011

(54) METHOD AND SYSTEM FOR SELECTIVELY BROADCASTING MEDIA

(75) Inventors: Jeffrey Lee Littlejohn, Alexandria, KY (US); David C. Jellison, Jr., Ogallala, NE (US)

(73) Assignee: Clear Channel Management Services, Inc., San Antonio, TX (US)

( * ) Notice: Subject to any disclaimer, the term of this patent is extended or adjusted under 35 U.S.C. 154(b) by 1191 days.

(21) Appl. No.: 11/535,347

(22) Filed: Sep. 26, 2006

(51) Int. Cl.
*H04H 20/74* (2008.01)

(52) U.S. Cl. ..... 455/3.02; 455/3.06; 455/556.1; 379/101.01

(58) Field of Classification Search ..... 455/45, 455/186.1, 3.06, 161.2, 3.02, 3.05, 184.1, 455/185.1, 556.1, 556.2, 90.3; 379/101.01, 379/90.01, 102.01, 102.02; 709/228, 202, 709/203, 218, 219, 231, 232, 223
See application file for complete search history.

(56) References Cited

U.S. PATENT DOCUMENTS

| | | | | |
|---|---|---|---|---|
| 6,223,210 | B1 | 4/2001 | Hickey | |
| 6,577,716 | B1 | 6/2003 | Minter et al. | |
| 6,964,061 | B2 | 11/2005 | Cragun et al. | |
| 7,017,120 | B2 * | 3/2006 | Shnier | 715/783 |
| 7,346,320 | B2 * | 3/2008 | Chumbley et al. | 455/186.1 |
| 7,689,705 | B1 * | 3/2010 | Lester et al. | 709/231 |
| 2005/0198317 | A1 * | 9/2005 | Byers | 709/228 |
| 2007/0143466 | A1 * | 6/2007 | Shon et al. | 709/223 |

* cited by examiner

*Primary Examiner*—Sujatha Sharma
(74) *Attorney, Agent, or Firm*—Edward J. Marshall, Attorney at Law PLLC

(57) ABSTRACT

A method and apparatus for broadcasting media events, the method including the steps of providing a sequence of media events in a first server, the sequence of media events including at least one media event of a first type and a plurality of media events of a second type; playing the sequence from the first server to a second server prior to a predetermined broadcast time; and storing at the second server at least a part of the sequence received from the first server. The method may further include the steps of broadcasting the sequence from the first server at the predetermined broadcast time; broadcasting the stored sequence from the second server at the predetermined broadcast time while continuing to play the sequence from the first server to the second server, the step of broadcasting from said second server further including the steps of skipping at least one media event of a first type, broadcasting a subsequent one of the plurality, and supplementing the stored sequence with media events stored in the second server separately identifiable from the stored sequence.

51 Claims, 10 Drawing Sheets

METHOD AND SYSTEM FOR SELECTIVELY BROADCASTING MEDIA

BACKGROUND OF THE INVENTION

1. Field of the Invention

The present invention relates to a system and method for selectively providing content.

2. Background of the Invention

Many broadcast stations, such as radio broadcast stations, use computers running broadcast automation software, such as the NexGen Digital™ radio broadcast automation software provided by Prophet Systems Innovation, to automate some, if not all, of an entire broadcast. Broadcast content typically includes various media events such as songs, movies, advertisements, jingles, news spots, traffic, radio host commentary, interviews, station identification, segues, beds, promos, station identification, time and temperature, voice tracks and the like.

Generally, broadcast content is stored electronically in individual files, and is compiled into a broadcast program log or playlist that may include a chronological arrangement of various types of broadcast content to create the desired listening "experience." For example, a playlist for a radio music program may include a series of songs with station identification and advertisements interspersed at various intervals.

Many broadcast stations are part of larger broadcast systems or networks that allow broadcast programs to be shared. For example, one broadcast station may host a live program, record that program, and transmit that program to another broadcast station for rebroadcast.

When networked broadcast stations share programming, content broadcast transmitted from one broadcast station may not be appropriate for another broadcast station. For example, a broadcast program may include songs, movies and/or advertisements pertinent to a particular audience and not to another audience. Or, a program from one broadcast station may be transmitted to multiple broadcast stations having diverse audiences, such as paid subscribers to an Internet-based broadcast, or to HD radio listeners, and certain content may be undesirable for that audience. There is a need, therefore, for a method and apparatus of selectively providing content.

DETAILED DESCRIPTION OF THE INVENTION

Figure 1:
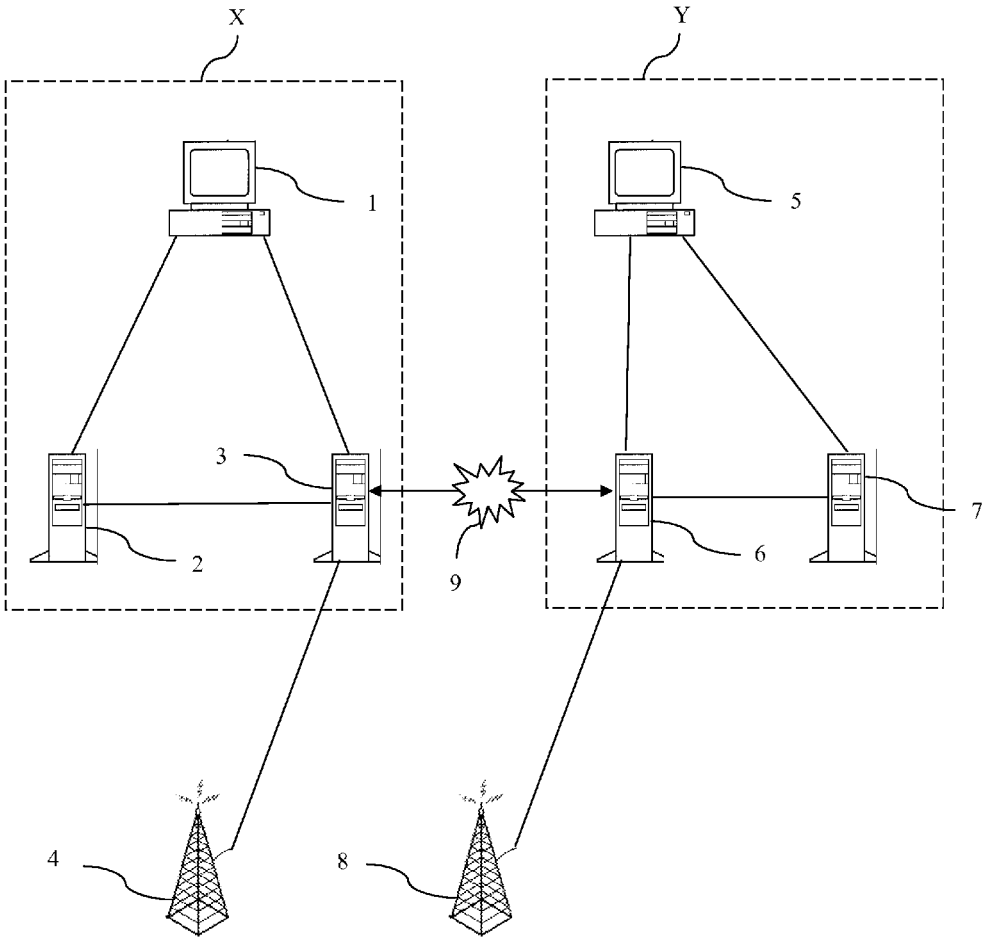
FIG. 1 depicts one embodiment of a broadcast system having a first broadcast station X and a second broadcast station Y.

A detailed description is provided primarily in the context of radio broadcasting, but those skilled in the art will appreciate that the invention is not limited to radio broadcast operations. As seen in the embodiment of FIG. 1, a broadcast station X may include a primary workstation 1 using broadcast automation software to automate broadcast operations. The primary workstation 1 may be connected to a primary file server 2 and a primary audio server 3. Another broadcast station Y may include a secondary workstation 5 also using broadcast automation software to automate broadcast operations. The secondary workstation 5 may be connected to a secondary file server 7 and a secondary audio server 6. In this embodiment, the primary audio server 3 and secondary audio server 6 are connected to antennas 4 & 8, respectively. In this embodiment, the primary audio server 3 is connected to the secondary audio server 6 through a network 9, such as the Internet or wide area network. Such connection may, of course, be direct or indirect, electrical and/or physical, and may be wired or wireless. Those skilled in the art will recognize that the primary workstation 1 and secondary workstation 5, along with their respective file servers 2 & 7 and audio servers 3 & 6, may be co-located at a broadcast station or located apart, and may, for example, serve different radio audiences.

In this embodiment, the primary and secondary workstations 1 & 5 each use NexGen Digital™ v.2.4.19.1 broadcast automation software. The primary file server 2 and primary audio server 3 connected to the primary workstation 1 may, for example, be mounted in a common rack and connected to other hardware that may be used for broadcast station operation, such as to an audio switcher, a universal power supply, digital reel-to-reel hardware, real-time editor hardware, mixing boards and the like. A similar arrangement may be provided for the secondary workstation 5, secondary file server 7 and secondary audio server 6. Those skilled in the art will recognize that the environment illustrated in FIG. 1 and described herein is not intended to limit the present invention. Indeed, those skilled in the art will recognize that other alternative hardware and environments may be used without departing from the scope of the present invention. A server computer may, for example, include a processor, a random access memory, data storage devices (e.g. hard, floppy, and/or CD-ROM disk, drives, etc.), data communications devices (e.g., modems, network interfaces, etc.), display devices, (e.g., CRT display, LCD display, etc.), and input devices (e.g., mouse pointing devices, keyboard, CD-ROM drive, etc.). A server may, for example, be attached to other devices, such as a read-only memory, a video card, a bus interface, a printer, etc. Those skilled in the art will appreciate that any combination of the above components, or any number of different combinations, peripherals, and other devices, may be used with the server. Likewise, those skilled in the art will recognize that various servers, workstations, hardware and software described herein, whether termed "file server," "audio server," "workstation," "first server," "second server," "switcher," "editor," "storage device," "broadcast automation software," "buffer," "adapter," "broadcast station" and the like, and the capabilities and features ascribed thereto, may refer to different functions, programs and/or applications of one or more computing devices in a single location or spread over multiple locations, and may be implemented in hardware or software or some combination of the two.

In this embodiment, the primary and secondary file servers 2 & 7 may be used to store various media events, and the primary and secondary audio servers 3 & 6 may be used to mix and play media events, for example, over the air or over the Internet as a radio broadcast. Accordingly, the primary and secondary audio servers 3 & 6 may each be provided with a multistream PCI audio adapter (not shown) designed for broadcast use and having, for example, one "record" stream input and six "play" stream outputs. Such an adapter may be any suitable adapter, and may, for example, be the model ASI6122 audio adapter from Audioscience.

Figure 2:
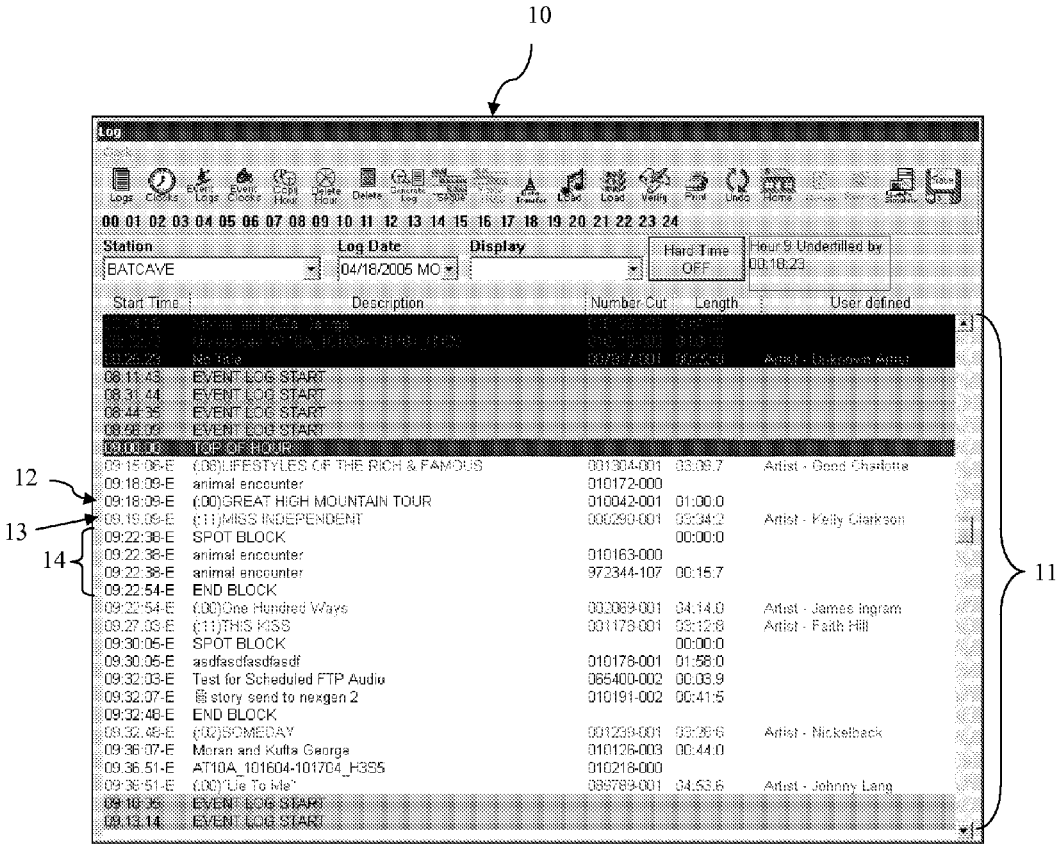
FIG. 2 depicts one embodiment of a media event log.

A user at the primary workstation 1 may create a radio broadcast program by using the broadcast automation software to arrange audio content into a log of media events. As seen in the embodiment of FIG. 2, the exemplary broadcast automation software allows a broadcast station to automate the production of a radio program through creation of a media event log 11, from which a playlist may be generated. As used herein, the terms "log" and "playlist" may be used interchangeably. As used in the claims, the term "automation playlist" includes both "log" and "playlist," and a generally connotes a sequence of media events. In the event log interface 10, a broadcaster may define, over a 24-hour period, when and how various media events will be played in order to create the radio broadcast "experience," as is known to those skilled in the art. The media event log 11 may thus generally be a time-based collection of media events arranged in playback order, and may include metadata associated with the media events, such as song title, artist, radio station identification, macros (user-defined sequences of media events) and the like. Generally, a media event log may cover a day's worth of programming, but other time periods may be used, as well, and the event log 11 may be planned and created well in advance of actual broadcast. The event log 11 may, for example, indicate to the broadcaster whether airtime has been adequately filled, and describe the type of media events to fill various day parts.

In the embodiment of FIG. 2, the media event log 11 provides a list of media events arranged according to the time during which each media event will play. In this embodiment, the event log 11 sets out an exemplary morning show radio program that includes advertisement spots and songs. For example, a one-minute long "Great High Mountain Tour" advertisement spot 12 is shown as scheduled to play at 9:18:09, followed by the "Miss Independent" song 13 by artist Kelly Clarkson, which is shown as scheduled to play at 9:19:09. Also, for example, an "animal encounter" advertisement spot 14 is scheduled to begin play at 9:22:38, and end at 9:22:54.

As is known in the art, the relationship between the media events may be defined to enhance the radio broadcast "experience." The various transitions between media events may include, for example, crossfades, overlap, clipping, ducking, and fade in and fade out. In the audio context, for example, "fading" generally refers to the process of changing the volume of a media event over time. "Fade in" and "fade out" thus generally refer to increasing and decreasing, respectively, the volume of a media event over time, and "cross fading" generally refers to simultaneously fading out the end of one media event, while fading in the beginning of the next media event. "Fading" is commonly done at the beginning and end of a media event, but may be accomplished during other portions of a media event, as well. "Clipping" generally refers to the process of excluding a portion of a media event during playback, such as the beginning or end of a song or video element. "Ducking" generally refers to reducing the volume level of background audio while another media event, such as a voice track, is playing. "Overlap" generally refers to simultaneous performance of media events.

So defined and arranged, the media events of such a log, or playlist, may be played in real-time as, for example, an on-air broadcast to provide the radio broadcast "experience." With reference to FIG. 1, the broadcast automation software running on the primary workstation 1 directs retrieval of the media events listed in the playlist from the primary file server 2, and directs the primary audio server 3 to mix and play the media events as they appear in the media event log or playlist. The primary audio server 3 may play the media events for broadcast via antenna 4. Those skilled in the art will recognize that broadcast could easily be over the Internet or some other network. Those skilled in the art will appreciate that the term "broadcast" includes transmission of media from one to many, e.g., from a broadcast station or network of broadcast stations to a consuming audience, by any transmission medium.

Figure 3:
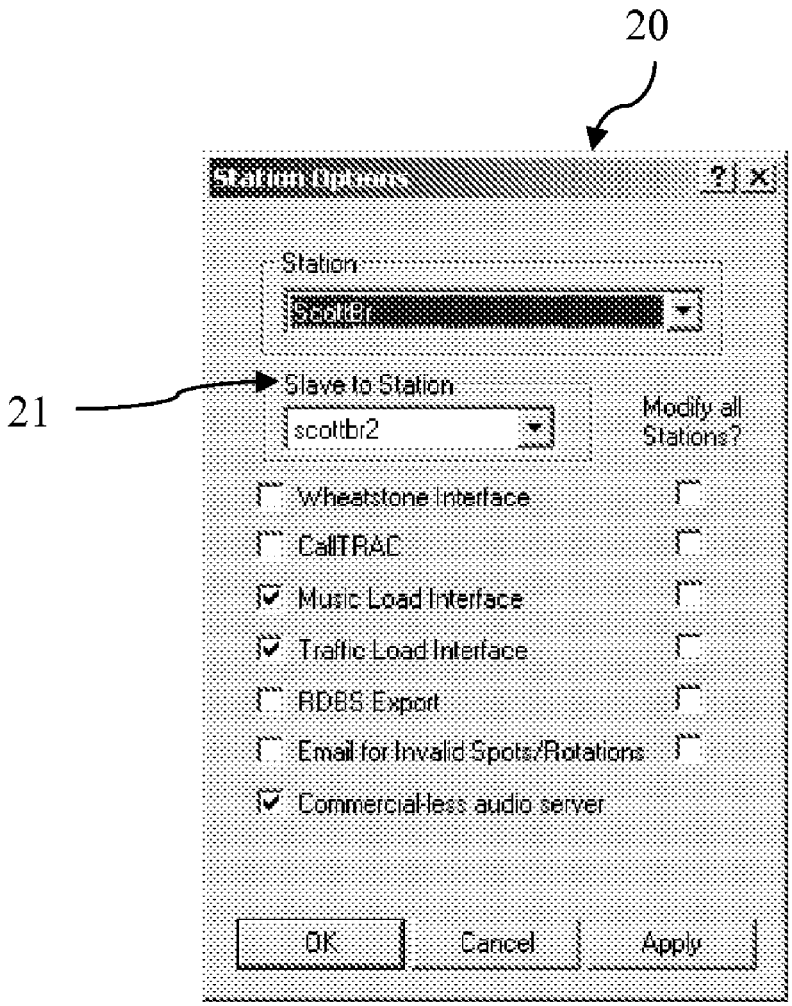
FIG. 3 depicts an embodiment of a user interface that may be provided by broadcast automation software for establishing the relationship between two broadcast stations.

In this embodiment, the secondary audio server 6 may be configured to function as a slave to the primary audio server. With reference to FIGS. 1 and 3, a user at the secondary workstation 5 may establish the relationship 21 between the secondary audio server (represented by the "Commercial-less Audio Server" in the list of stations) and primary audio server (represented by the "scottbr2" station) through a user interface 20 that may be provided by the broadcast automation software running on the secondary workstation 5. Thus, in addition to broadcasting the media events via antenna 4, the primary audio server 3 may also play the media events directly to the secondary audio server 6. Such play may be in real-time. Specifically, the primary audio server 3 may play through an output of its audio adapter the media events into the input of the secondary audio server's 6 audio adapter. The secondary audio server 6 store the media stream in a buffer until directed by the secondary workstation to start playing the buffered media as, for example, an over-the-air broadcast via antenna 8. Those skilled in the art will appreciate that the buffer may be any suitable computer-readable medium.

Figure 4:
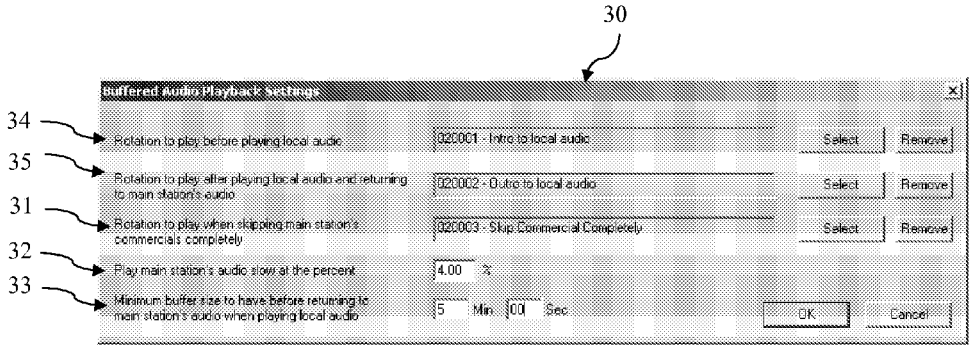
FIG. 4 depicts an embodiment of a user interface that may be provided by broadcast automation software for configuring playback of media events from a buffer.

In this embodiment, when playing media events from the secondary audio server 6 buffer, various undesired media events may be skipped. For example, it may be desired to play a rotation in which all of the advertisements are skipped. As seen in the embodiment of FIG. 4, the broadcast automation software running on the secondary workstation may accordingly provide a user interface 30 to permit that rotation 31 to be specified.

Figure 5:
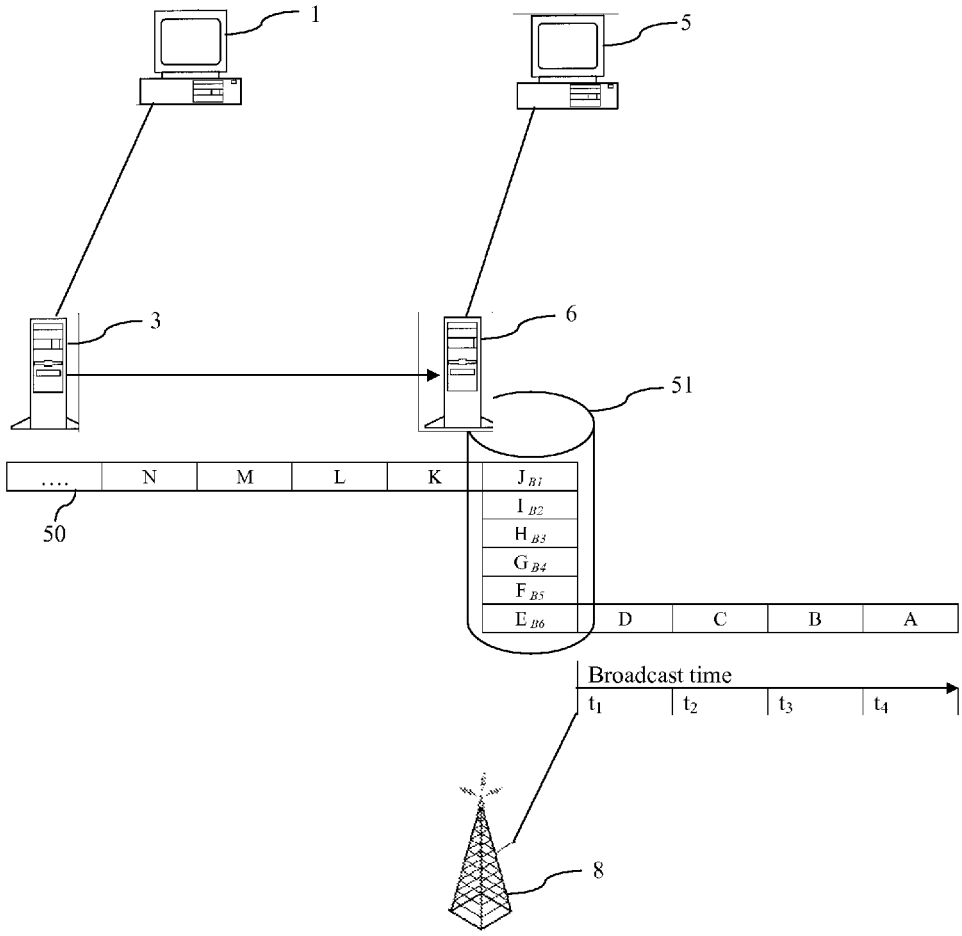
FIG. 5 depicts playing media events from a first audio server into the buffer of a second audio server, and broadcasting those media events from the second audio server.

With reference to the embodiment of FIG. 5, the primary audio server 3 may play a sequence 50 of media events A, B, C, D, . . . in real time into the buffer 51 of the secondary audio server 6 (the file servers 2 and 7 of FIG. 1 are not shown here). That is, the sequence 50 of media events may be streamed from the primary audio server 3 to the buffer 51, and after a portion of that sequence 50 has been stored in the buffer 51, the sequence 50 of media events may be broadcast from antenna 8 at broadcast time t1 from the secondary audio server 6 on a first-in first-out basis. Generally, amount of buffer $B_1 \ldots B_6$ may be specified to be a certain duration of real-time media event play. Use of the buffer 51 allows the playlist of media events to be altered prior to broadcasting, as discussed in further detail below.

Figure 6:
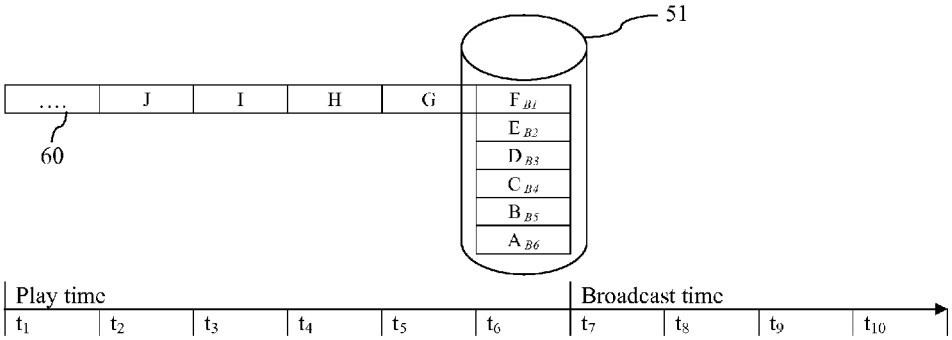
FIG. 6 depicts playing media events from a first audio server into the buffer of a second audio server at time $t_1$ prior to broadcasting.

In one embodiment, the primary audio server 3 and the secondary audio server 6 may be scheduled to begin broadcasting the same playlist of media events at the same time. The primary audio server 3 may, for example, broadcast the playlist of media events to one audience, and the secondary audio server 6 may broadcast an advertisement-free version of that playlist to another audience. The primary audio server 3 may begin streaming 60 the media events, in playlist sequence, into the buffer 51, as seen with reference to FIG. 6. If, for example, a buffer of six minutes $B_1 \ldots B_6$ is desired, the primary audio server 3 may begin playing the stream 60 of media events A, B, C, . . . into the buffer six minutes (at time $t_1$) before the scheduled broadcast time $t_7$. Thus, at the broadcast time $t_7$, the buffer 51 will contain six minutes-worth of audio.

Figure 7:
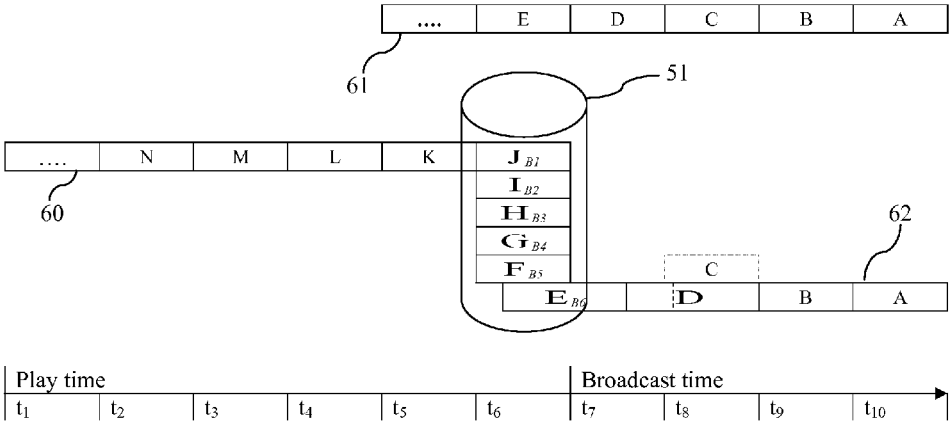
FIG. 7 depicts the media events of the embodiment of FIG. 6 broadcast from both the primary audio server and secondary audio server starting at broadcast time $t_7$ and continuing through time $t_{10}$, the media events also played from the primary audio server to the buffer of a second audio server, where broadcast from the second audio server involves skipping a media event and stretching subsequent media events while broadcasting to compensate for such skipping.

Turning to FIG. 7, broadcast of stream 61 of media events from the primary audio server 3 and broadcast of stream 62 from the secondary audio server 6 may be scheduled to begin at time $t_7$. In FIG. 7, broadcast has begun and has continued through time $t_{10}$. During that time, the primary audio server 3 may continue to play the stream 60 of media events into the buffer 51. As noted above, the primary audio server 3 may be provided with an audio adapter that allows multiple output streams 60 & 61.

In this embodiment, the user has configured the broadcast automation software of the secondary workstation 5 to instruct the audio server 6 to identify and not play advertisement spots. In the embodiment of FIG. 2, for example, spots to be skipped may be marked by the primary audio server with special markers that are displayed in the media event log 11 as "spot blocks," as with the animal encounter spot 14. According to that embodiment, the secondary audio server 6 may then detect those spot blocks and skip the spot or spots marked by the spot blocks.

In the embodiment of FIG. 7, spot C may be an advertisement spot. Spot C may be desired in the media event stream 61 from the primary audio server 3, but undesired in the media event stream 62 from the secondary audio server 6. Accordingly, spot C may be identified and not played from the buffer, and the secondary workstation's 5 broadcast automation software may instruct the secondary audio server 6 to play media event D immediately after playing media event B. Removal of spot C from the rotation, however, shortens the scheduled playlist by some amount of time, i.e., the buffer amount is "used up" by skipping media events. To fill that airtime gap, the broadcast automation software may instruct the audio server 6 to slow down (stretch out) playback of one or more, or all, subsequent spots. In this embodiment, the user may configure the broadcast automation software to instruct the secondary audio server 6 to immediately play media event D after media event B and stretch, i.e., slow down, the subsequent media events D, E, F, . . . As seen in FIG. 4, for example, the user has specified a stretch percentage 32 of 4%, and in this embodiment may stretch playback by up to 20%. Stretching subsequent songs by 4%, for example, may fill an additional 2.4 minutes of airtime per hour. In this embodiment, such stretching may be accomplished, as is known in the art, without altering the pitch of subsequent spots to avoid, for example, "draggy turntable" voices. Those skilled in the art will appreciate that other stretching and/or squeezing ratios may be applied. Alternatively, the broadcast automation software may be configured to instruct the audio server 6 to stretch out playback of only certain spots, for example, only media events D and E, as may be needed to fill airtime gap left by removal of spot C. In this embodiment, such stretching may be utilized for as long as may be needed to re-fill the buffer 51 to a minimum amount of media event play time. That is, media events in the media stream 62 may be played out from the buffer 51 more slowly than the media events of the stream 60 are played from the primary audio server 3 into the buffer 51, and the difference in play rate results in refilling the buffer 51.

Referring generally to the embodiment of FIG. 7, for example, it may be that media events A and B are songs, media event C is an advertisement spot, and media events D, E and F are songs (the remaining media events may be, in this example, of various types). In this example, each media event may be one minute long. Playback of songs A . . . F will require 6 minutes of airtime. If broadcast is scheduled to begin from the primary audio server 3 and from the secondary audio server 6 at the top of the 9 a.m. hour (09:00:00), and a buffer of six minutes is required, the primary audio server 3 may begin playing the stream 1 of media events into the buffer 51 at 08:54:00, as described above in connection with the embodiment of FIG. 6. Thus, at broadcast time 09:00:00 ($t_7$), media events A . . . F will be stored in the buffer 51 and ready for broadcast. In this embodiment, therefore, both the primary audio server 3 and the secondary audio server 6 will begin their broadcast at 09:00:00 with song A and followed by song B. Immediately after song B finishes playing, the primary audio server 3 will begin playing advertisement spot C. The secondary audio server will, however, remove advertisement C from the playlist rotation (as shown by the dash-marked "timeslot" C), and begin playing song D immediately after playing song B. Removal of advertisement C shortens that airtime play of media events A . . . F from the secondary audio server by one minute. To fill that airtime gap, and "catch up" to the broadcast 61 from the primary audio server 3, the secondary audio server 6 may stretch songs D, E and F to fill that space, so that the broadcast 62 from the secondary audio server 6 is substantially synchronous with the broadcast 61 from the primary audio server 3 by the time song F begins to play at 09:06:00. As noted above, of course, such stretching may be spread out over fewer or additional subsequent spots or all subsequent spots. Those skilled in the art will recognize that such stretching may, for example, be delayed until later in the playlist, or may be limited to song D. Generally, immediately playing song D after song B with or without stretching out one or more subsequent spots may draw down the amount of media event playtime stored in the buffer.

Figure 8:
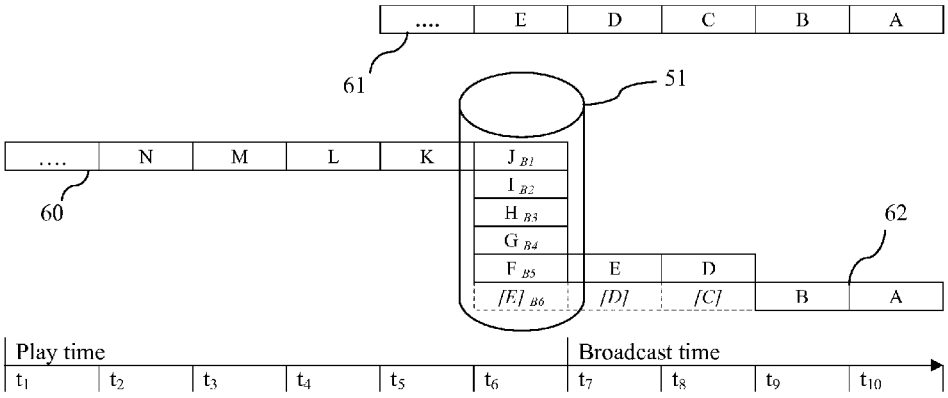
FIG. 8 depicts the media events of the embodiment of FIG. 6 broadcast from both the primary audio server and secondary audio server starting at broadcast time $t_7$ and continuing through time $t_{10}$, the media events also played from the primary audio server to the buffer of a second audio server, where broadcast from the second audio server involves skipping a media event and broadcasting media events subsequent to the skipped media event without stretching the subsequent media events.

Those skilled in the art will also recognize that stretching may not be used at all. In the embodiment of FIG. 8, spot C may be removed and songs D, E, F, . . . may be played immediately after song B without stretching, and the buffer amount may be accordingly reduced to five minutes of airtime ($B_1 \ldots B_5$). The bracketed media event designations [C], [D] and [E] in the units marked by dashed lines illustrate the sequence of media events that would exist without removal of spot C.

Accordingly, an appropriate buffer may be established and maintained at a level sufficient to provide a reserve of media events to fill airtime gaps. For example, a minimum buffer size of five minutes may be sufficient to cover typical advertisement spots if stretching is used. For longer station breaks, such as for news, a longer buffer may be required, and may range, for example, between 7.5 minutes and 14 minutes. In the embodiment of FIG. 4, for example, the minimum buffer size 33 is set at five minutes.

Also, the broadcast 62 from the secondary audio server 6 may be supplemented from a secondary playlist. A user at the secondary workstation 6 may create a secondary log or playlist of media events suitable for the intended audience of the secondary broadcast station. The secondary log or playlist may be created using the automation broadcast software to, for example, create a clock with empty song slots, define a music load format for the station (such as "R&B"), based on the music load format generate a log of music similar to the media event log 11 of FIG. 2, and load the music from the secondary file server 7 to the secondary audio server 6. Those skilled in the art will appreciate that the secondary playlist may comprise a single type of media events or may comprise a variety of types of media events, such as songs, news and advertisements pertinent to the secondary station's broadcast audience, station identification, radio personality commentary and the like.

Figure 9:
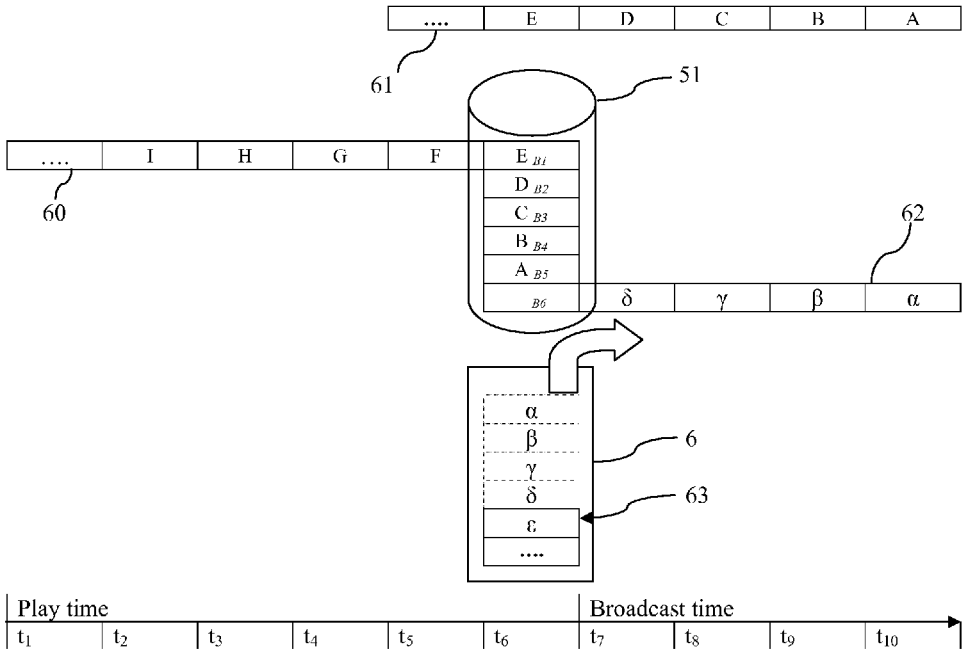
FIG. 9 depicts the media events of the embodiment of FIG. 6 both broadcast from the primary audio server and played into the secondary audio server starting at broadcast time $t_7$, and broadcasting a secondary playlist from the secondary audio server at broadcast time $t_7$ until the buffer is sufficiently full to begin broadcasting the media events stored.

In one embodiment, with reference to FIG. 9, the primary audio server 3 may begin broadcasting the primary playlist at 09:00:00 (time $t_7$) while simultaneously playing the primary playlist to the buffer 51 of the secondary audio server 6. The secondary audio server 6 may broadcast from a secondary playlist 63 of spots $\alpha$, $\beta$, $\gamma$, $\delta$, $\epsilon$, . . . at 09:00:00 while an adequate reserve $B_1 \ldots B_6$ of the media events from the primary audio server 3 is being stored in the buffer 51, and then switch over to broadcast of the buffered primary playlist when the buffer requirements $B_1 \ldots B_6$ are met. Thereafter, the secondary audio server 6 may remove undesired media events as described above.

Figure 10:
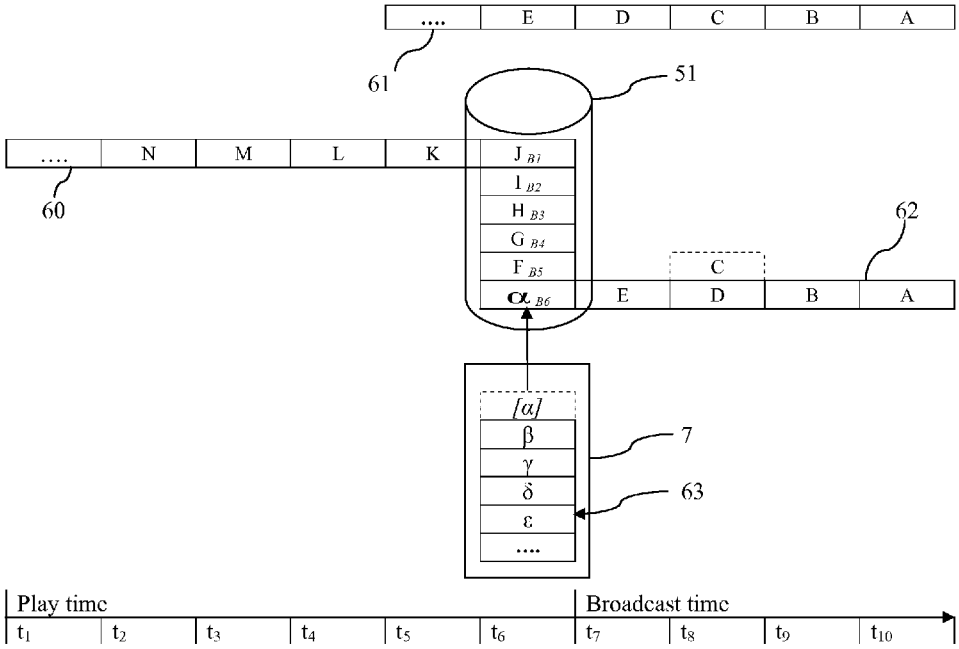
FIG. 10 depicts the media events of the embodiment of FIG. 6 broadcast from both the primary audio server and secondary audio server starting at broadcast time $t_7$ and continuing through time $t_{10}$, the media events also played from the primary audio server to the buffer of a second audio server, where broadcast from the second audio server involves skipping a media event, playing a subsequent media event and adding to the buffer a media event from an alternative playlist.

In the embodiment of FIG. 10, the secondary audio server 6 may refill the buffer with one or more media events from the secondary playlist 63, thus drawing media events from the secondary file server 7. For example, song a may be added to the buffer, and, if necessary, stretched (or squeezed) to fill the airtime that would have been filled by advertisement C. Alternatively, songs $\alpha$ and $\beta$ (or other media events from playlist 63) may both be added to the buffer (not shown), and squeezed to fill the airtime. Those skilled in the art will recognize that songs D, E, . . . may also be squeezed or stretched as may be appropriate to accommodate media events from the secondary playlist 63, and that additional buffered media events may be removed from or used to fill the airtime as the case may be if, for example, such squeezing and/or stretching of songs D, E, . . . is inappropriate. Additionally, those skilled in the art will recognize that media events from the secondary playlist 63 may be added to the buffer to supplement any part of the broadcast 62, including supplementation immediately after song B.

Also, if during broadcast the amount of buffered media becomes inadequate to meet airtime fill requirements, the secondary playlist 63 may be played until the buffer requirements are once again met. For example, if the buffer has less than 15 seconds of media event play time stored, the secondary playlist 63 may be played until some threshold buffer requirement is met. Alternatively, if the primary playlist 61 is exhausted, the secondary audio server 6 may switch back to broadcasting the secondary playlist 63.

Figure 11:
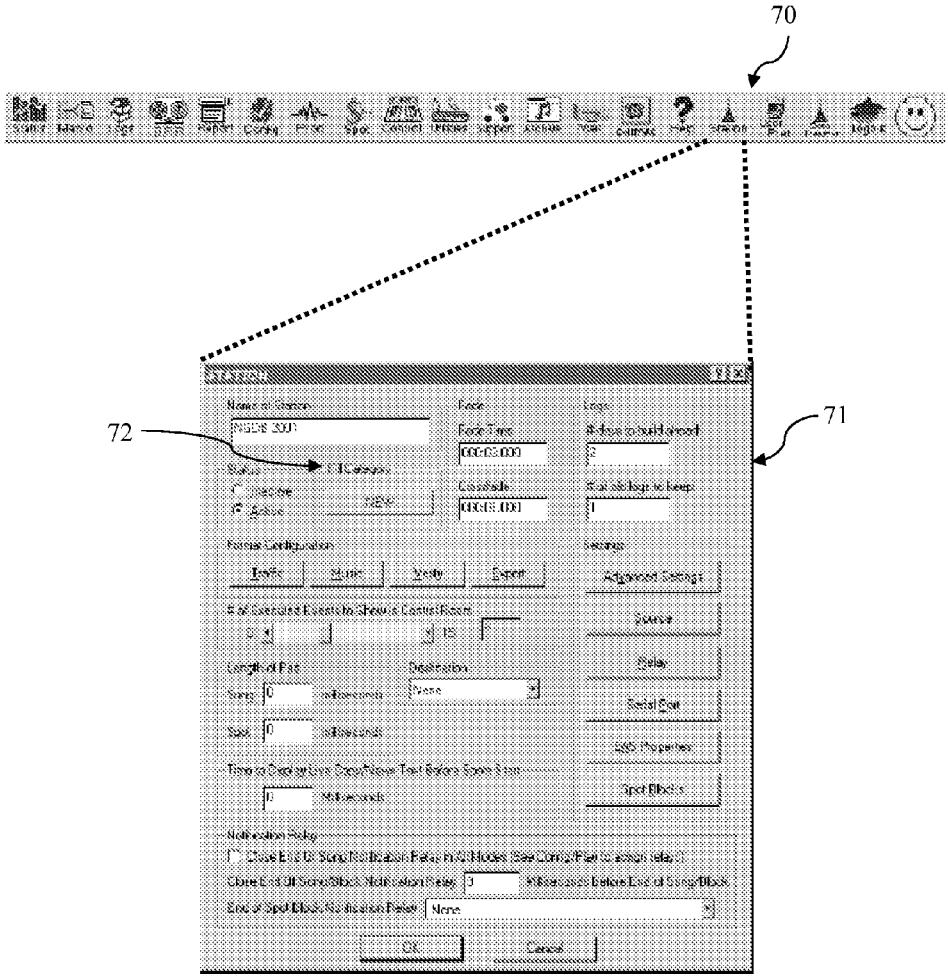
FIG. 11 depicts an embodiment of a user interface provided by broadcast automation software for establishing a fill category for a broadcast station.

If the secondary playlist 63 is also exhausted, the secondary audio server 6 may play filler material established as appropriate for that station. In the embodiment of FIG. 11, for example, the broadcast automation software may allow a user to create a category of songs that may be used to fill gaps in airtime. The user may do so by accessing the configuration menu 70 of the exemplary broadcast automation software installed on the secondary workstation 5, and selecting the "station" option to bring up an interactive dialog box 71 that allows the user to change the fill category 72. The category of fill media events selected may be valid for that station, e.g., "R&B" filler material for an "R&B" station format. Those skilled in the art will appreciate that a secondary playlist is not required, and that random filler material may just as easily be used.

Those skilled in the art will recognize that the transition between media events of the secondary playlist and media events of the primary playlist may be defined in a manner noted above. For example, the last media event played from the secondary playlist may cross fade into the first media event played from the primary playlist. In the embodiment of FIG. 4, for example, a user may establish the rotation 34 to play immediately before transitioning from the primary playlist to the secondary playlist, and may establish the rotation 35 to play in transitioning from the secondary playlist to the primary playlist. In the embodiment of FIG. 4, the user has established "intros" to segue into a media event from the secondary playlist and "outros" to segue out of that media event.

In one embodiment, the broadcast automation software installed on the secondary workstation may provide an indication to the user of the status of the secondary audio server's buffer, such as how full the buffer is, which portion of the primary playlist is stored in the buffer, the types of media events stored in the buffer and the like. The broadcast automation software may also allow a user to "jump ahead" in the buffer to, for example, skip portions of the playlist. The broadcast automation software may allow a user to rearrange the portions of the playlist stored in the buffer. Thus, the playlist does not necessarily have to be played from the buffer on a first-in first-out basis. Additionally, the broadcast automation software may allow a user to "dump" buffered media events into a media events log of the secondary station, and update the playback times in that media events log based on the buffer information. Furthermore, those skilled in the art will recognize that the secondary audio server 6 may output more than one stream from buffer 51, and may separately manipulate those streams as discussed herein. For example, one stream may be entirely advertisement free, and another stream may have advertisements inserted from a secondary playlist.

While the invention has been described with reference to the foregoing embodiments, other modifications will become apparent to those skilled in the art by study of the specification and drawings. For example, the foregoing description may apply in a television, video, and text broadcast context, where the automation playlist may comprise media events of audio and/or visual nature, and the broadcast equipment involve, for example, television broadcasting equipment. Also, the automation playlist need not be generated by broadcast automation software, and may simply be an arrangement of media events generated by known music mixing software, such as Adobe Audition. It is thus intended that the following appended claims define the invention and include such modifications as fall within the spirit and scope of the invention.

We claim:

1. A method for broadcasting media events, said method comprising the steps of:

a) providing a sequence of media events in a first server, said sequence of media events including at least one media event of a first type and a first plurality of media events of a second type;

b) playing said sequence from said first server to a second server prior to a predetermined broadcast time;

c) storing at said second server at least a part of said sequence received from said first server; and d) broadcasting said stored sequence from said second server at said predetermined broadcast time while continuing to play said sequence from said first server to said second server, said step of broadcasting from said second server further comprising stretching at least a portion of said stored sequence.

2. The method of claim 1, said step of broadcasting further comprising:

i) skipping at least one said media event of a first type; and ii) broadcasting a subsequent one of said first plurality of media events of a second type.

3. The method of claim 2, said step of broadcasting from said second server further comprising the step of stretching said subsequent media event.

4. The method of claim 2, said step of broadcasting from said second server further comprising the step of stretching at least one of subsequent said media events of a second type.

5. The method of claim 2, said step of broadcasting from said second server further comprising the step of stretching all subsequent said media events of a second type.

6. The method of claim 2, said method further comprising the steps of:

a) providing a second plurality of media events of a second type at said second server, said second plurality being separately identifiable from said sequence stored at said second server; and b) supplementing said sequence stored at said second server with at least one of said second plurality.

7. The method of claim 6, said step of broadcasting from said second server further comprising the step of stretching or compressing said at least one of said second plurality.

8. The method of claim 6, wherein said second plurality is a second sequence of media events.

9. The method of claim 8, wherein said second sequence is an automation playlist.

10. The method of claim 1, said method further comprising the step of re-arranging media events of said sequence stored in said second server prior to broadcasting from said second server.

11. The method of claim 1, said method further comprising the step of re-arranging media events of said sequence stored in said second server while broadcasting from said second server.

12. The method of claim 1, wherein said sequence is an automation playlist.

13. The method of claim 1, wherein said media event of a first type is an advertisement spot.

14. The method of claim 1, wherein said first plurality of media events of a second type comprises songs or video.

15. The method of claim 1, wherein said first server and said second server are part of a radio broadcast network.

16. The method of claim 1, wherein said first server and said second server are part of a television broadcast network.

17. The method of claim 1, said method further comprising the steps of:

a) providing a second plurality of media events of a second type at said second server, said second plurality being separately identifiable from said sequence stored at said second server;

b) broadcasting said stored sequence from said second server at said predetermined broadcast time while continuing to play said sequence from said first server to said second server, said step of broadcasting from said second server further comprising the steps of:

i) skipping at least one said media event of a first type; and ii) broadcasting a subsequent one of said first plurality, if available; or iii) if said subsequent one of said first plurality is not available, broadcasting at least one of said second plurality.

18. The method of claim 1, said method further comprising the steps of:

a) specifying a minimum amount of play time of said sequence to be stored in said second server during broadcast from said second server;

b) providing a second plurality of media events of a second type at said second server, said second plurality being separately identifiable from said sequence stored at said second server; and c) broadcasting said stored sequence from said second server at said predetermined broadcast time while continuing to play said sequence from said first server to said second server, said step of broadcasting from said second server further comprising the steps of:

i) skipping at least one said media event of a first type; and ii) if said minimum amount is stored in said second server, broadcasting a subsequent one of said first plurality; or iii) if said minimum amount is not stored in said second server, broadcasting at least one of said second plurality at least until said minimum amount is stored in said second server.

19. The method of claim 2, said method further comprising the steps of:

a) specifying a minimum of play time of said sequence to be stored in said second server during broadcast from said second server;

b) providing a second plurality of media events of a second type at said second server, said second plurality being separately identifiable from said sequence stored at said second server; and c) if said minimum is not stored at said second server, supplementing said stored sequence with at least one of said second plurality.

20. A method for broadcasting media events, said method comprising the steps of:

a) providing a sequence of media events in a first server, said sequence of media events including at least one media event of a first type and a first plurality of media events of a second type;

b) playing said sequence from said first server to a second server at said predetermined broadcast time;

c) storing at said second server at least a part of said sequence received from said first server;

d) providing a second plurality of media events of a second type at said second server, said second plurality being separately identifiable from said sequence stored at said second server;

e) broadcasting said second plurality from said second server at said predetermined broadcast time while continuing to play said sequence from said first server to said second server;

f) specifying a minimum amount of play time of said sequence to be stored at said second server; and g) in response to said minimum amount being stored at said second server, stopping broadcasting of said second plurality and starting broadcasting of said stored sequence from said second server.

21. The method of claim 20, said step of broadcasting said stored sequence from said second server further comprising the steps of:

a) skipping at least one said media event of a first type; and b) if said minimum amount is stored in said second server, broadcasting a subsequent one of said first plurality; or c) if said minimum amount is not stored in said second server, broadcasting at least one of said second plurality at least until said minimum amount is stored in said second server.

22. The method of claim 20, said method, further comprising the steps of:

a) skipping at least one said media event of a first type;

b) broadcasting a subsequent one of said first plurality; and c) if said minimum amount is not stored in said second server, supplementing said stored sequence with at least one of said second plurality.

23. The method of claim 20, said step of broadcasting from said second server further comprising the step of stretching or compressing said at least one of said second plurality.

24. The method of claim 20, said step of broadcasting from said second server further comprising the steps of:

a) skipping at least one said media event of a first type; and b) broadcasting a subsequent one of said first plurality, if available; or c) if said subsequent one of said first plurality is not available, broadcasting at least one of said second plurality.

25. The method of claim 20, said method further comprising the step of arranging said second plurality into a sequence.

26. The method of claim 25, wherein said sequence is an automation playlist.

27. A system for broadcasting media events, said system comprising:

a) a first server, said first server configured to play a sequence of media events to a second server prior to a predetermined broadcast time, said sequence including at least one media event of a first type and a first plurality of media events of a second type;

b) a second server connected to said first server, said second server configured to receive said sequence from said first server, store at least a part of said sequence, and broadcast said sequence at said predetermined broadcast time while continuing to receive said sequence from said first server, said second server further configured to, while broadcasting, skip at least one said media event of a first type and broadcast a subsequent one of said first plurality; and c) said second server further configured to stretch said subsequent media event.

28. The system of claim 27, wherein said second server is further configured to stretch at least one of subsequent said media events of a second type.

29. The system of claim 27, wherein said second server is further configured to stretch all subsequent said media events of a second type.

30. The system of claim 27, wherein said second server is further configured to re-arrange media events of said sequence stored therein prior to broadcasting from said second server.

31. The system of claim 27, wherein said second server is further configured to re-arrange media events of said sequence stored therein while broadcasting from said second server.

32. The system of claim 27, wherein said sequence is an automation playlist.

33. The system of claim 27, wherein said media event of a first type is an advertisement spot.

34. The system of claim 27, wherein said first plurality of media events of a second type comprises songs or video.

35. The system of claim 27, wherein said first server and said second server are part of a radio broadcast network.

36. The system of claim 27, wherein said first server and said second server are part of a television broadcast network.

37. The system of claim 27, wherein a) said second server is further configured to broadcast a second plurality of media events of a second type, said second plurality being separately identifiable from said sequence stored at said second server, said second server further configured to, while broadcasting, skip at least one said media event of a first type and supplement said sequence stored at said second server with at least one of said second plurality.

38. The system of claim 37, wherein said second server is further configured to stretch or compress said at least one of said second plurality.

39. The system of claim 37, wherein said second plurality is a second sequence of media events.

40. The system of claim 38, wherein said second sequence is an automation playlist.

41. The system of claim 27, wherein a) said second server is further configured to broadcast a second plurality of media events of a second type, said second plurality being separately identifiable from said sequence stored at said second server, said second server further configured to, while broadcasting, skip at least one said media event of a first type, broadcast a subsequent one of said first plurality, if available, or if said subsequent one of said first plurality is not available, broadcast at least one of said second plurality.

42. The system of claim 27, wherein a) said second server is further configured to broadcast a second plurality of media events of a second type, said second plurality being separately identifiable from said sequence stored at said second server, said second server further configured to store a minimum amount of play time of said sequence during broadcast from said second server, and configured to, while broadcasting, skip at least one said media event of a first type, broadcast, if said minimum amount is stored in said second server, a subsequent one of said first plurality, or if said minimum amount is not stored at said second server, broadcast at least one of said second plurality at least until said minimum amount is stored in said second server.

43. The system of claim 27, wherein said second server is further configured to broadcast a second plurality of media events of a second type, said second plurality being separately identifiable from said sequence stored at said second server, said second server further configured to store a minimum amount of play time of said sequence during broadcast from said second server, and, if said minimum is not stored at said second server, supplement said stored sequence with at least one of said second plurality.

44. A system for broadcasting media events, said system comprising:

a) a first server, said first server configured to play a sequence of media events to a second server at a predetermined broadcast time, said sequence including at least one media event of a first type and a first plurality of media events of a second type;

b) a second server connected to said first server, said second server configured to receive said sequence from said first server and store at least a part of said sequence, said second server further configured to broadcast a second plurality of media events of a second type at said predetermined broadcast time while continuing to receive said sequence from said first server, said second plurality being separately identifiable from said sequence stored at said second server;

c) said second server further configured to store a minimum amount of play time of said sequence during broadcast from said second server and, when said minimum amount is stored in said server, to stop broadcasting said second plurality and start broadcasting said stored sequence from said second server.

45. The system of claim 44, wherein said second server is further configured to skip at least one said media event of a first type; and broadcast, if said minimum amount is stored in said second server, a subsequent one of said first plurality, or if said minimum amount is not stored in said second server, broadcast at least one of said second plurality at least until said minimum amount is stored in said second server.

46. The system of claim 45, wherein said second server is further configured to skip at least one said media event of a first type; broadcast a subsequent one of said first plurality; and, if said minimum amount is not stored in said second server, supplement said stored sequence with at least one of said second plurality.

47. The system of claim 45, wherein said second server is further configured to stretch or compress said at least one of said second plurality.

48. The system of claim 44, wherein said second server is further configured to skip at least one said media event of a first type; and broadcasting a subsequent one of said first plurality, if available, or if said subsequent one of said first plurality is not available, broadcast at least one of said second plurality.

49. The system of claim 44, wherein said second server is further configured to arrange said second plurality into a sequence.

50. The system of claim 49, wherein said sequence is an automation playlist.

51. The system of claim 44, wherein said second server includes a buffer for receiving said sequence.

* * * * *